United States Patent [19]

Miki

[11] Patent Number: 4,684,269

[45] Date of Patent: Aug. 4, 1987

[54] APPARATUS FOR PRINTING WITH CHARACTER FONTS AND DOT-MATRIX PRINTING IN THE SAME LINE

[75] Inventor: Yasuhiro Miki, Nagoya, Japan

[73] Assignee: Brother Kogyo Kabushiki Kaisha, Japan

[21] Appl. No.: 765,213

[22] Filed: Aug. 13, 1985

[30] Foreign Application Priority Data

Aug. 21, 1984 [JP] Japan ..... 59-174720

[51] Int. Cl.[4] ..... B41J 3/12; B41J 3/54

[52] U.S. Cl. ..... 400/82; 400/124; 400/144.2; 400/149; 101/93.12

[58] Field of Search ..... 400/82, 149, 171, 144.2, 400/124, 150, 151, 323, 323.1; 101/93.12

[56] References Cited

U.S. PATENT DOCUMENTS

| | | | |
|---|---|---|---|
| 3,185,823 | 5/1965 | Ellersick, Jr. et al. | 364/900 X |
| 3,576,582 | 4/1971 | Smith, Jr. | 346/34 |
| 4,025,830 | 5/1977 | Delaporte | 400/225 X |
| 4,026,403 | 5/1977 | Inose | 400/151 X |
| 4,204,779 | 5/1980 | Lee | 400/149 X |
| 4,281,938 | 8/1981 | Phillips | 400/151 X |
| 4,376,585 | 3/1983 | Fromme et al. | 400/185 |
| 4,389,126 | 6/1983 | Honma | 400/82 |
| 4,444,519 | 4/1984 | Howell et al. | 400/82 |
| 4,462,707 | 7/1984 | Falconieri | 400/225 |
| 4,469,459 | 9/1984 | Trezise et al. | 400/216.1 |
| 4,472,073 | 9/1984 | Valle et al. | 400/185 |
| 4,527,918 | 7/1985 | Yamamoto | 400/17 X |
| 4,595,303 | 6/1986 | Kuzuya et al. | 400/82 |

FOREIGN PATENT DOCUMENTS

| | | | |
|---|---|---|---|
| 11721 | 11/1978 | European Pat. Off. | 400/82 |
| 22397 | 1/1981 | European Pat. Off. | 400/82 |
| 3104351 | 9/1982 | Fed. Rep. of Germany | 400/124 |
| 54-156725 | 12/1979 | Japan | 400/82 |
| 56-5775 | 1/1981 | Japan | 400/82 |
| 58-124687 | 7/1983 | Japan | 400/224.1 |
| 58-128859 | 8/1983 | Japan | 400/82 |
| 58-171986 | 10/1983 | Japan | 400/224.1 |

OTHER PUBLICATIONS

*IBM Tech. Disc. Bulletin,* D. J. Moore, vol. 22, No. 5, Oct., 1979, pp. 1754–1755.

*IBM Tech. Disc. Bulletin,* J. G. Barnes, vol. 26, No. 8, Jan., 1984, pp. 4370–4371.

*IBM Tech. Disc. Bulletin,* R. T. Sha, vol. 27, No. 1B, Jun., 1984, pp. 841–843.

*Primary Examiner*—Paul T. Sewell

*Attorney, Agent, or Firm*—Parkhurst & Oliff

[57] ABSTRACT

A composite printing apparatus including a first printing assembly which has character fonts, and a second printing assembly for printing characters with a matrix of dots, wherein a series of input printing data corresponding to a plurality of successive characters are classified into a first group of printing data for a first printing with the character fonts of the first printing assembly, and a second group of printing data for a second printing with the matrix of dots of the second printing assembly. One of the first and second printing assemblies is first activated according to corresponding one of the first and second groups of printing data, and subsequently the other printing assembly is activated according to the other one of the first and second groups of printing data.

12 Claims, 7 Drawing Figures

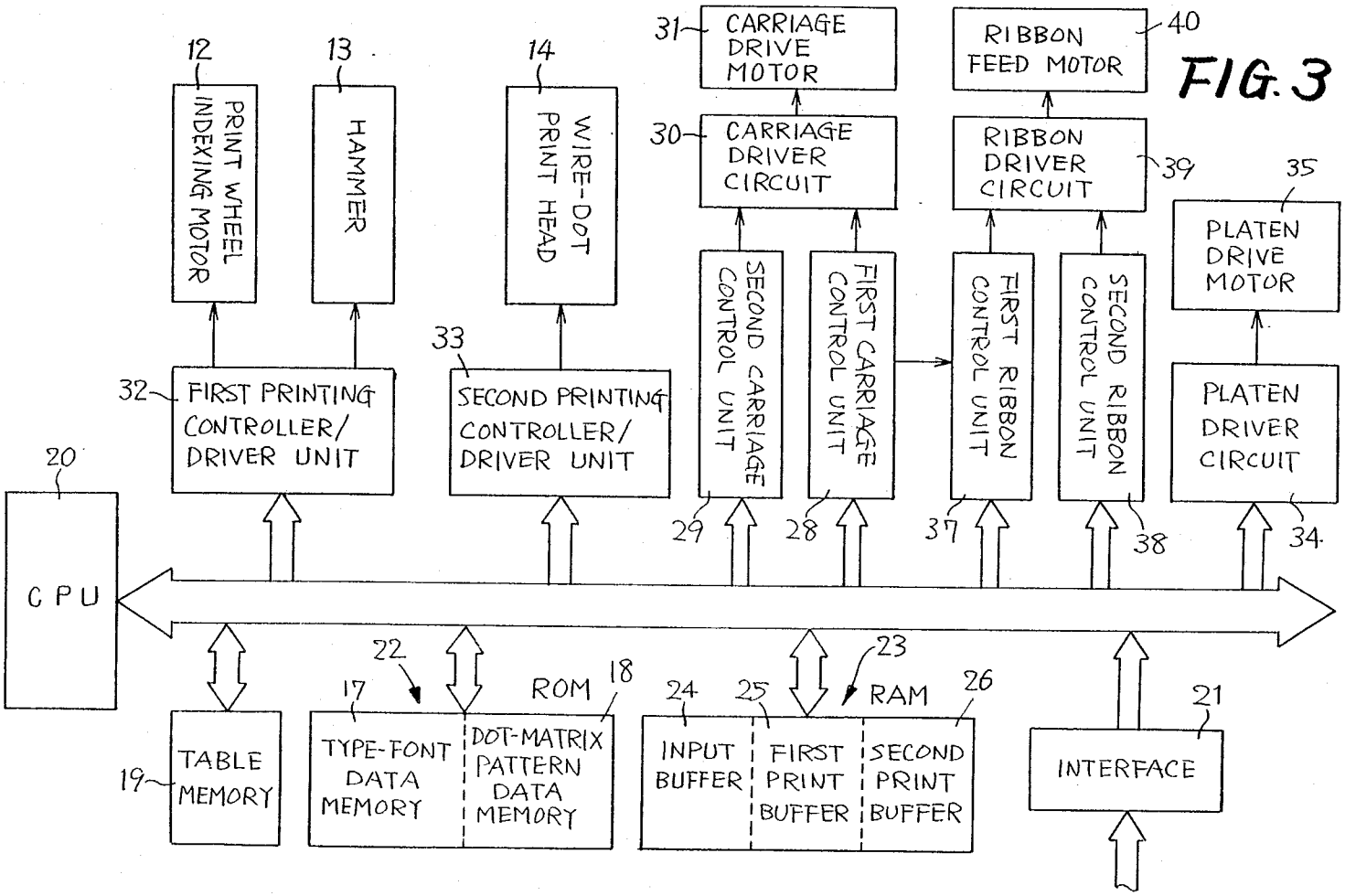
FIG. 3
PLATEN DRIVE MOTOR
35
PLATEN DRIVER CIRCUIT
34
RIBBON FEED MOTOR
40
RIBBON DRIVER CIRCUIT
39
SECOND RIBBON CONTROL UNIT
38
FIRST RIBBON CONTROL UNIT
37
INTERFACE
21
CARRIAGE DRIVE MOTOR
31
CARRIAGE DRIVER CIRCUIT
30
FIRST CARRIAGE CONTROL UNIT
28
SECOND CARRIAGE CONTROL UNIT
29
RAM
23
SECOND PRINT BUFFER
26
FIRST PRINT BUFFER
25
INPUT BUFFER
24
WIRE-DOT PRINT HEAD
14
SECOND PRINTING CONTROLLER/ DRIVER UNIT
33
ROM
18
DOT-MATRIX PATTERN DATA MEMORY
HAMMER
13
FIRST PRINTING CONTROLLER/ DRIVER UNIT
22
TYPE-FONT DATA MEMORY
17
PRINT WHEEL INDEXING MOTOR
12
32
TABLE MEMORY
19
CPU
20

FIG. 4

HEXADECIMAL VALUE OF REMAINING FOUR BITS

HEXADECIMAL VALUE OF FIRST FOUR BITS

| | 2 | 3 | 4 | 5 | 6 | 7 | 8 | 9 | A | B | C | D | E | F |
|---|---|---|---|---|---|---|---|---|---|---|---|---|---|---|
| 0 | sp | 0 | @ | P | ` | p | Ç | É | á | ⠿ | ╚ | ╝ | α | ≡ |
| 1 | ! | 1 | A | Q | a | q | ü | æ | í | ⠿ | ═ | ═ | β | ± |
| 2 | " | 2 | B | R | b | r | é | Æ | ó | ⠿ | ═ | ═ | γ | ≥ |
| 3 | # | 3 | C | S | c | s | â | ô | ú | ═ | ═ | ═ | π | ≤ |
| 4 | $ | 4 | D | T | d | t | ä | ö | ñ | ═ | ═ | ═ | Σ | ∫ |
| 5 | % | 5 | E | U | e | u | à | ò | Ñ | ═ | ═ | ═ | σ | ∫ |
| 6 | & | 6 | F | V | f | v | å | û | ª | ═ | ═ | ═ | μ | ÷ |
| 7 | ' | 7 | G | W | g | w | ç | ù | º | ═ | ═ | ═ | τ | ≈ |
| 8 | ( | 8 | H | X | h | x | ê | ÿ | ¿ | ═ | ═ | ═ | Φ | • |
| 9 | ) | 9 | I | Y | i | y | ë | Ö | ⌐ | ═ | ═ | ═ | Θ | • |
| A | * | : | J | Z | j | z | è | Ü | ¬ | ═ | ═ | ═ | Ω | • |
| B | + | ; | K | [ | k | { | ï | ¢ | ½ | ═ | ═ | ■ | δ | √ |
| C | , | < | L | \ | l | ¦ | î | £ | ¼ | ═ | ═ | ■ | ∞ | ⁿ |
| D | − | = | M | ] | m | } | ì | ¥ | ¡ | ═ | ═ | ■ | ∅ | ² |
| E | . | > | N | ^ | n | ~ | Ä | Pts | « | ═ | ═ | ■ | ∈ | ▮ |
| F | / | ? | O | _ | o | DEL | Å | ƒ | » | ═ | ═ | ■ | ∩ | DEL |

FIRST PRINTING IN ONE DIRECTION

SECOND PRINTING IN OPPOSITE DIRECTION

APPARATUS FOR PRINTING WITH CHARACTER FONTS AND DOT-MATRIX PRINTING IN THE SAME LINE

BACKGROUND OF THE INVENTION

1. Field of the Art

The present invention relates to a composite printing apparatus which is capable of two different modes of printing, i.e., printing by means of type elements or type fonts, and dot-matrix printing with a matrix of dots.

Generally, a printing operation by means of character fonts (hereinafter referred to as "type-printing") is advantageous in printing quality, but disadvantageous due to its limited number of characters such as letters, numerals and symbols and its relatively low printing speed. In a dot-matrix printing operation, desired characters are printed by dot-matrix patterns defined by appropriate combinations of dots which are formed by print wires while a print head is moved at a suitable rate. Hence, a dot-matrix printer has substantially no limitation in the number of characters printable, and is comparatively high in printing speed. However, the dot-matrix printing with these advantages suffers a comparatively low level of printing quality.

In view of such circumstances in the prior art, a composite printing apparatus has been proposed, which is equipped with two printing units or assemblies for performing both of type-printing and dot-matrix printing. In such a printing apparatus known in the art, however, the two printing assemblies are selectively moved, as required, into a printing position on a print line along the platen of the printer so that a printing operation is effected by the selected one of the two printing assemblies.

2. Problem Solved by the Invention

Such composite printers require complicated arrangements for selective movements of the two printing assemblies to a printing position, and suffer a relatively low printing efficiency.

SUMMARY OF THE INVENTION

It is therefore an object of the present invention to provide a composite printing apparatus which is capable of selective printing by means of character fonts and a matrix of dots, with improved efficiency and with a simple control arrangement, wherein when successive characters (e.g., a line of characters) represented by input printing data consist of characters to be printed with the character fonts and the remaining characters to be printed with the dot matrix, the printing with the character fonts is performed before or after the printing with the dot matrix.

According to the invention, there is provided a composite printing apparatus including a first printing assembly wich has character fonts, and a second printing assembly for printing characters with a matrix of dots, comprising: separator means for classifying a series of input printing data corresponding to a plurality of successive characters, into a first group of printing data for a first printing with the character fonts of the first printing assembly, and a second group of printing data for a second printing with the matrix of dots of the second printing assembly; and printing control means for activating one of the first and second printing assemblies according to corresponding one of the first and second groups of printing data, and subsequently activating the other printing assembly according to the other one of the first and second groups of printing data. Preferably, a series of input printing data corresponding to a line of successive characters are classified into the first and second groups of printing data.

According to an advantageous embodiment of the invention, the separator means comprises an input buffer for storing the input printing data, a first print buffer for storing first converted data corresponding to the first group of printing data, and a second print buffer for storing second converted data corresponding to the second group of printing dta. In one form of this embodiment, the first converted data comprises type-font data for selecting and impacting the character fonts of the first printing assembly, and the second converted data comprises dot-matrix pattern data representative of dot-matrix patterns corresponding to the characters to be printed by the second printing assembly.

In another form of the above embodiment, the separator means causes the first and second print buffers to store space data in addition to the first and second converted data, respectively. The space data to be stored in the first print buffer correspond to the second converted data to be stored in the second print buffer, while the space data to be stored in the second print buffer correspond to the first converted data to be stored in the first print buffer. In this instance, tab data may be stored in the first and second print buffers, in addition to the first and second converted data, respectively. The tab data to be stored in the first print buffer correspond to the second converted data, while the tab data to be stored in the second print buffer correspond to the first converted data.

According to another advantageous embodiment, a common carriage is provided to support the first and second printing assemblies. The carriage is reciprocated along a line of printing in opposite directions. The first printing by the first printing assembly is effected while the carriage is moved in one of the opposite directions. The second printing by the second printing assembly is effected while the carriage is moved in the other direction.

BRIEF DESCRIPTION OF THE DRAWING

The above and other objects, features and advantages of the present invention will be better understood from reading the following description of the preferred embodiments taken in connection with the accompanying drawing in which:

FIG. 3 is a block diagram showing an electric control system of the printing apparatus of FIG. 1;

FIG. 4 is a view illustrating a table of coded data stored in a table memory of the control system;

DETAILED DESCRIPTION OF THE PREFERRED EMBODIMENTS

Referring to the accompanying drawing, preferred embodiments of the invention will be described in detail.

Figure 1:
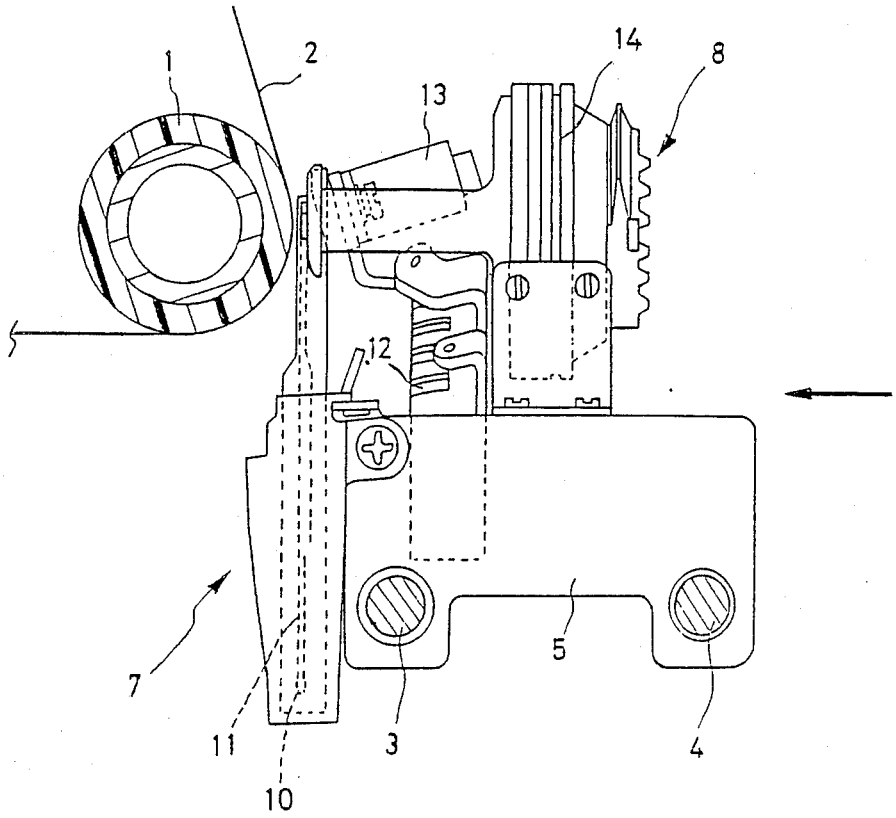
FIG. 1 is a side elevational view of printing assemblies of one embodiment of a composite printing apparatus of the present invention.
Figure 2:
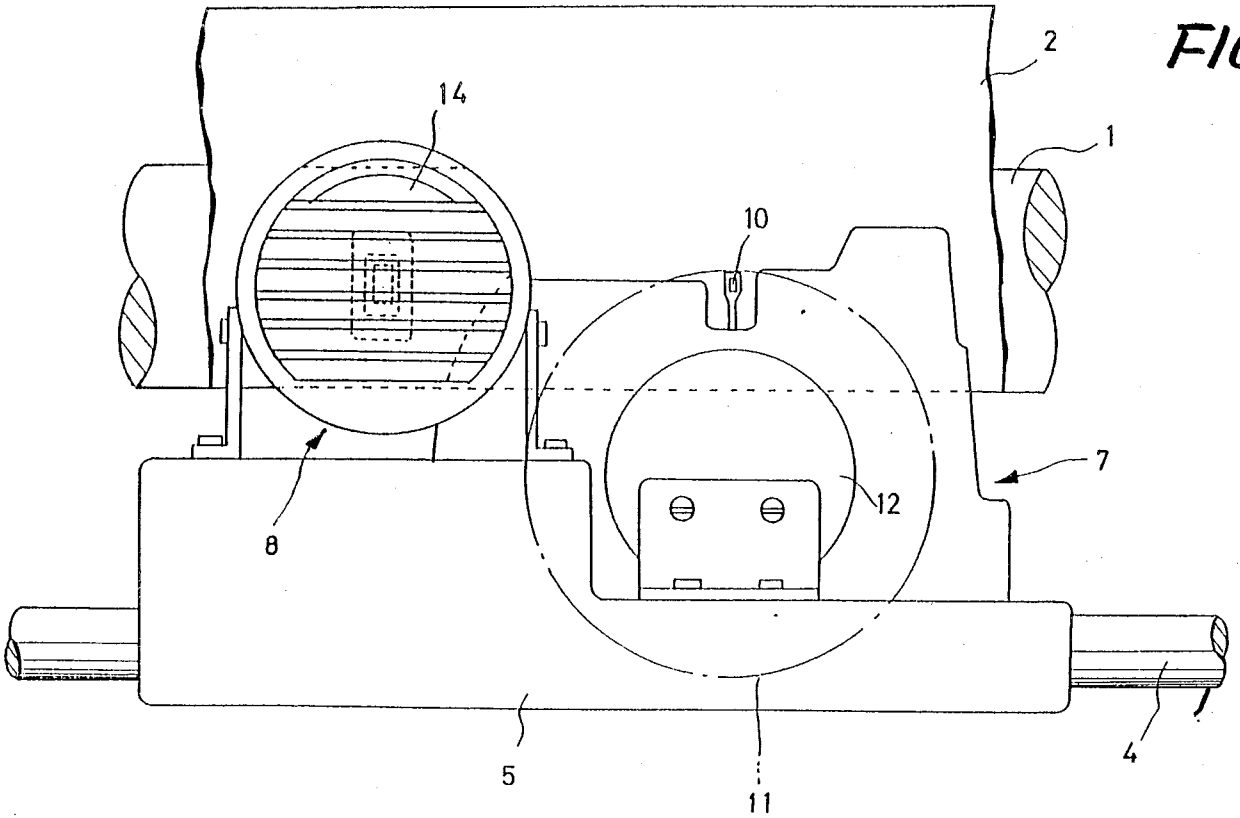
FIG. 2 is a fragmentary enlarged front elevational view, taken in the direction of arrow of FIG. 1.

There is shown in FIGS. 1 and 2 a composite printing mechanism of a printer of one embodiment of the invention, wherein reference numeral 1 designates a platen which is rotatably supported at its opposite longitudinal ends by a main frame (not shown) of the printer. The platen 1 is driven by a platen drive motor 35 (FIG. 3) in the form of a stepper motor, DC or AC servomotor, or any other suitable drive motor, such that the platen 1 is rotated in selected one of forward and reverse directions as required, through an angle necessary to effect a desired printing operation. The platen 1 serves as means for supporting a sheet of paper 2, and cooperates with the platen drive motor 35 to constitute paper feeding means for feeding the paper in a direction pependicular to a line of printing.

The printer includes a carriage 5 supported by two guide rods 3, 4 which extend parallel to the axis of rotation of the platen 1. The carriage 5 is slidable on the guide rods 3, 4 in selected one of opposite directions along a line of printing parallel to the platen 1, by a desired distance by means of a carriage drive motor 31 (FIG. 3) in the form of a stepper motor, DC or AC servomotor or any other suitable drive motor, via a suitable timing belt (not shown). The carriage 5 carries a first printing assembly 7 and a second printing assembly 8, which have a first and a second printing point, respectively. As shown in FIG. 2, these first and second printing points are spaced from each other in a direction parallel to the line of printing, i.e., along the platen 1.

The first printing assembly 7 includes a print wheel 11 of daisy type, an indexing motor 12 such as a stepper motor, and a hammer 13. The print wheel 11 has a multiplicity of radial spokes which are spaced from each other circumferentially of the wheel 11. The spokes carry at their free ends 96 character fonts 10 that are abuttable against the surface of the platen 1 to print corresponding characters. The indexing motor 12 operates to rotate the print wheel 11 to bring the selected character fonts 10 into the first print point right above the surface of the platen 1. The hammer 13 is located behind the print wheel 11 and opposite to the first print point in order to strike the selected character font 10 at its back against the sheet of paper 2 held on the platen 1. In the meantime, the second printing assembly 8 includes a wire-dot print head 14 having plural print wires (not shown) which are selectively pushed toward the platen 1, by means of an electromagnetic device (not shown), to form a dot-matrix pattern corresponding to a desired character, as well known in the art.

On the carriage 5, there is removably mounted a ribbon cassette (not shown) which accommodates an inked ribbon in multiple folds. The inked ribbon has an active portion extending past the first and second printing points of the first and second printing assemblies 7, 8, and is fed by a ribbon feed motor 40 (FIG. 3) via ribbon feed rolls (not shown).

Referring to FIGS. 3 and 4 showing a control system and a table memory 19 of the instant printer, reference numeral 20 designates a central processing unit which receives input printing data from an external device through an interface 21. The input printing data comprises a series of character data representing characters to be printed. To the central processing unit 20 (hereinafter referred to as "CPU 20"), there are connected a table memory 19, a read-only memory 22 (hereinafter called "ROM 22") and a random-access memory 23 (hereinafter called "RAM 23"), via a data bus.

The table memory 19 stores a batch of converted character data which correspond to input printing data that represent multiple characters printable on the instant composite printer, such as letters, numerals, symbols and graphical figures (graphic representation elements), as illustrated in FIG. 4. Described in more detail, the table memory 19 has many memory locations each of which stores converted character data consisting of eight bits which represent each character. In this specific embodiment, these eight bits are divided into the first four high-order bits as counted from the most significant bit, and the remaining low-order four bits. Combinations of the first four bits and the remaining four bits are assigned to represent the 96 characters listed in FIG. 4, wherein the values of the four bits are expressed in hexadecimal notation. The 96 character fonts 10 provided on the print wheel 11 correspond to the 96 characters which are represented by converted character data whose hexadecimal values of the first four bits are [2] through [7] inclusive. The other characters (letters, symbols and graphic representation elements) are printed with a matrix of dots by the wire-dot print head 14. Stated the other way, the batch of converted character data stored in the table memory 19 are classified into a first and a second group of converted character data. The first group of converted character data represents a first group of characters which are printed by the first printing assembly 7 with the print wheel 11. The second group of the converted character data represents a second group of characters which are printed by the second printing assembly 8 with the wire-dot print head 14. This classification or separation into two groups is determined depending upon the value of the first four bits of each converted character data. That is, the character represented by input printing data is printed with the print wheel 11 if the value of the first four bits of the corresponding converted character data falls within the range from [2] through [7], when expressed in the hexadecimal notation. In this embodiment, therefore, this value [7] is used as a predetermined reference with which the value of each converted character data is compared when the corresponding input printing data is received by the CPU 20. This aspect will be described in more detail.

The ROM 22 has a type-font data memory 17 and a dot-matrix pattern data memory 18. The type-font data memory 17 stores type-font data which includes type selection data for bringing the character fonts 10 of the print wheel 11 into a printing position (first printing point), and impact data representative of impact forces with which the character fonts 10 are impacted. The impact forces are determined according to surface areas of the individual character fonts 10. The dot-matrix pattern data memory 18 stores dot-matrix pattern data which represent dot-matrix patterns corresponding to the characters to be printed by the wire-dot print head 14.

The RAM 23 has an input buffer 24, a first print buffer 25 and a second print buffer 26. The input buffer 24 is adapted to store a series of input printing data corresponding to a line of successive characters. The first print buffer 25 is adapted to store the type-font data which have been retrieved from the type-font data memory 17, according to the first group of converted character data of the table memory 19 which represent the characters which are printed by the print wheel 11. The second print buffer 26 is adapted to store the dot-matrix pattern data which have been retrieved from the dot-matrix pattern data memory 18, according to the second group of converted character data of the table memory 19 which represent the characters to be printed by the wire-dot print head 14. Namely, the first print buffer 25 stores the type-font data corresponding to the converted character data whose values of the first four bits are [2] through [7], while the second print buffer 26 stores the dot-matrix pattern data corresponding to the converted character data whose values of the first four bits are other than [2] through [7].

Also connected to the CPU 20 via the data bus are a first carriage control unit 28 and a second carriage control unit 29, to which a carriage driver circuit 30 is connected. The carriage driver circuit 30 controls the operation of the carriage drive motor 31. When a printing is performed by means of the first printing assembly 7, the first carriage control unit 28 applies a drive signal to the carriage driver circuit 30 to operate the carriage drive motor 31 so as to feed the carriage 5 in increments of a one-character distance along the line of printing. When a printing is performed by the second printing assembly 8, the second carriage control unit 29 applies a drive signal to the carriage driver circuit 30 to operate the carriage drive motor 31 so as to feed the carriage 5 continuously at a predetermined feed rate along the line of printing.

A first printing controller/driver unit 32 is connected to the CPU 20 via the data bus. This controller/driver unit 32 controls the operations of the previously described indexing motor 12 and hammer 13. More specifically, the first printing controller/driver unit 32 receives the type-font data from the first print buffer 25, and activates the indexing motor 12 by suitable angles according to the type selection data of the type-font data, for bringing the appropriate character fonts 10 of the print wheel 11 into the printing position. Further, the controller/driver unit 32 activates the hammer 13 to strike the selected character fonts 10 with optimum impact forces which are specified by the impact data of the type-font data. There is also connected to the CPU 20 a second printing controller/driver unit 33 which controls the operation of the wire-dot print head 14. The second printing controller/driver unit 33 receives the dot-matrix pattern data from the second print buffer 26, and selectively activates the appropriate print wires to print characters with a matrix of dots on the sheet of paper 2.

The platen drive motor 35 is controlled by a platen driver circuit 34 which is connected to the CPU 20 via the data bus. The driver circuit 34 receives a platen drive signal to operate the platen drive motor 35 to feed the sheet of paper 2 by a selected distance in the selected direction perpendicular to the line of printing. To the CPU 20, there are also connected via the data bus a first and a second ribbon control unit 37, 38 which selectively control a ribbon driver circuit 39 to control the ribbon feed motor 40. The first ribbon control unit 37 is connected to the first carriage control unit 28. When the first printing assembly 7 is operated, the first ribbon control unit 37 receives a ribbon-feed timing signal from the first carriage control unit 28, and applies to the ribbon driver circuit 39 a ribbon feed signal in response to the ribbon-feed timing signal, whereby the ribbon feed motor 40 is operated to feed the ribbon in increments of a one-character distance. When the second printing assembly 8 is operated, the second ribbon control unit 38 applies to the ribbon driver circuit 39 a ribbon feed signal to operate the ribbon feed motor 40 so as to feed the ribbon continuously at a predetermined rate.

Figure 5A:
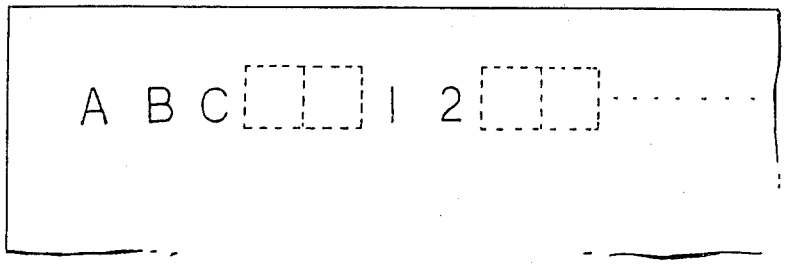
FIGS. 5(A) and 5(B) are views illustrating a bidirectional printing operation performed on the printing apparatus of FIG. 1.
Figure 5B:
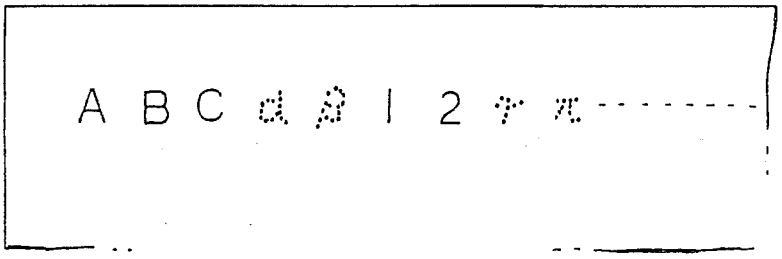

Referring next to FIGS. 5(A) and 5(B), the operations of the first and second printing assemblies 7, 8 will be described.

When the CPU 20 receives from an external device input printing data corresponding to a line of characters which consist of characters to be printed by the print wheel 11 and characters to be printed by the wire-dot print head 14, the CPU 20 stores the input printing data into the input buffer 24. Then, the CPU 20 refers to the code table in the table memory 19 to separate or classify the input printing data into a first group of printing data for printing by the first printing assembly 7, and a second group of printing data for printing by the second printing assembly 8. Stated in greater detail, the CPU 20 reads out from the table memory 19 the converted character data corresponding to the first input printing data, and compares the value of the first four bits of the read-out converted character data with a reference value [7]. If the value of the first four bits are [2] through [7], the CPU 20 judges that the first character represented by the read-out converted character data should be printed by the print wheel 11. Then, the CPU 20 retrieves the corresponding type-font data from the type-font data memory 17, and stores the retrieved type-font data into the first print buffer 25. In this case, space data representing a space is stored into the second print buffer 26. If the value of the converted character data read out from the table memory 19 is other than [2] through [7], then the CPU 20 judges that the first character should be printed by the wire-dot print head 14 of the second printing assembly 8. Accordingly, the CPU 20 retrieves the corresponding dot-matrix pattern data from the dot-matrix pattern data memory 18, and stores the retrieved dot-matrix pattern data into the second print buffer 26. In this case, space data representing a space is stored into the first print buffer 25. In the same manner, the CPU 20 reads out from the table memory 19 the converted character data which correspond to the individual input printing data stored in the input buffer 24, and checks whether the individual characters of the line repesented by the read-out converted character data should be printed by the first printing asembly 7 or by second printing assembly 8. For the characters to be printed by the first printing assembly 7, the corresponding type-font data are stored into the first print buffer 25, together with space data which correspond to the dot-matrix pattern data to be stored in the second print buffer 26. For the characters to be printed by the second printing assembly 8, the corresponding dot-matrix pattern data are stored into the second print buffer 26, together with space data which correspond to the type-font data to be stored in the first print buffer 25. If a plurality of successive characters are printed in the first or second printing assembly 7, 8, tab data may be stored in the first or second print buffer 25, 26 which does not store the type-font data or dot-matrix pattern data representing these plural successive characters. Thus, the characters that should be printed by the print wheel 11 are printed by executing the data in the first print buffer 25, while the other characters that should be printed by the wire-dot print head 14 are printed by executing the data in the second print buffer 26.

Upon receiving from the external device a signal to start printing by the first printing assembly 7, the CPU 20 retrieves the first type-font data from the first print buffer 25. The retrieved type-font data are fed to the first printing controller/driver unit 32, which operates the indexing motor 12 and the hammer 13, according to the type selection data and impact data of the type-font data, respectively. Consequently, the print wheel 11 is rotated by the indexing motor 12 to bring the corresponding character font 10 into the printing position, and the character font 10 in the printing position is impacted by the hammer 13 against the sheet of paper 2 via the inked ribbon, whereby the appropriate character is printed. Subsequently, the first carriage control unit 28 applies a signal to the carriage driver circuit 30 to move the carriage 5 by a one-character distance along the line of printing. As soon as the movement of the carriage 5 has been started, a ribbon-feed timing signal is generated from the first carriage control unit 28. In response to this timing signal, the first ribbon control unit 38 applies a signal to the ribbon driver circuit 39 to operate the ribbon feed motor 40 as long as the timing signal is present. Thus, the ribbon is fed by the one-character distance while the carriage 5 is moved. When the data retrieved from the first print buffer 25 is space data, no printing action of the first printing assembly 7 takes place, and the carriage 5 is merely moved by the one-character distance. By executing all of the type-font data and space data and/or tab data stored in the first print buffer 25, the characters represented by the type-font data are printed by the corresponding character fonts 10 during successive movements of the carriage 5 to the right, with spaces left at the positions corresponding to the space and/or tab data, as indicated in FIG. 5(A). These spaces (indicated in broken lines) correspond to the characters which will be printed by the wire-dot print head 14.

After completion of the printing by the print wheel 11 of the first printing assembly 7, and in response to an external signal from the external device to start the printing by the wire-dot print head 14 of the second printing assembly 8, the CPU 20 activates the second carriage control unit 29 to apply a drive signal to the carriage driver circuit 30 to operate the carriage drive motor 31 continuously at a predetermined speed, whereby the carriage 5 is moved continuously to the left at a predetermined speed. In the meantime, the CPU 20 activates the second ribbon control unit 38 to apply a ribbon feed signal to operate the ribbon feed motor 40 continuously at a predetermined speed, whereby the ribbon is fed continuously at a predetermined feed rate. While the carriage 5 and the ribbon are moved continuously, the CPU 20 retrieves the dot-matrix pattern data and space data and/or tab data from the second print buffer 26, and applies the retrieved data to the second printing controller/driver unit 33 to activate the wire-dot print head 14, so as to print the appropriate characters at the blank positions of the line which correspond to the space data stored in the first print buffer 25, as shown in FIG. 5(B).

According to the present embodiment which has been described hitherto, a series of printing data corresponding to a line of characters are stored in the input buffer 24, and the type-font data representing the characters to be printed by the print wheel 11 are stored into the first print buffer 25, while the dot-matrix pattern data representing the characters to be printed by the wire-dot print head 14 are stored into the second print buffer 26. Thus, the input buffer 24 and the first and second print buffers 25, 26 constitute a major part of separator means for classifying the printing data into a first group for printing by the first printing assembly 7, and a second group for printing by the second printing assembly 8. This classification is accomplished by referred to the code table in the table memory 19, to compare the values of the first four bits of the converted character data corresponding to the input printing data, with a reference value, as previously discussed. The type-font data and the space data and/or tab data stored in the first print buffer 25 are first executed to print the corresponding characters with the character fonts 10 of the print wheel 11 while the carriage 5 is moved to the right. Subsequently, the dot-matrix pattern data and the space data and/or tab data in the second print buffer 26 are executed to print the corresponding characters with the wire-dot print head 14 while the carriage 5 is moved to the left.

While the first and second print buffers 25, 26 of the illustrated embodiment are adapted to store the type-font data and the dot-matrix pattern data which have been retrieved from the type-font and dot-matrix pattern data memories 17, 18, respectively, it is possible that the first print buffer 25 stores the converted character data whose values of the first four bits are [2] through [7] while the second print buffer 26 stores the converted character data whose values of the first four bits are other than [2] through [7]. In this instance, the printing operations of the first and second printing assemblies 7, 8 are controlled according to the type-font data and the dot-matrix pattern data which are directly retrieved from the respective memories 17, 18 according to the converted character data stored in the first and second print buffers 25, 26.

In the illustrated embodiment, the input printing data are always checked against the code table of the table memory 19 to retrieve the corresponding type-font and dot-matrix pattern data from the respective memories 17, 18 and store these type-font data and dot-matrix pattern data in the first and second print buffers 25, 26. However, it is possible that all characters represented by the input printing data are printed solely by the print wheel 11 or by the wire-dot print head 14. In this case, the appropriate one of the two printing modes is selected, for example, by mode selection data received from the external device, or by a selector switch provided on the printer. According to this arrangement, the type-font data or dot-matrix pattern data which have been retrieved from the type-font or dot-matrix pattern data memory 17, 18, are not temporarily stored in the first or second print buffer 25, 26, but directly applied to the first or second printing controller/driver unit 32, 33.

Although the illustrated embodiment is adapted so that the printing by the print wheel 11 and the printing by the wire-dot print head 14 are effected while the carriage 5 is moved in the right and left directions, respectively, it is possible to reverse the order of these two printing operations. Namely, the dot-matrix printing may be effected while the carriage 5 is moved to the right. Further, the printing by the print wheel 11 and the dot-matrix printing may be performed in the same direction. In this case, the carriage 5 must be returned at the end of the first printing, before the second printing is initiated.

Figure 6:
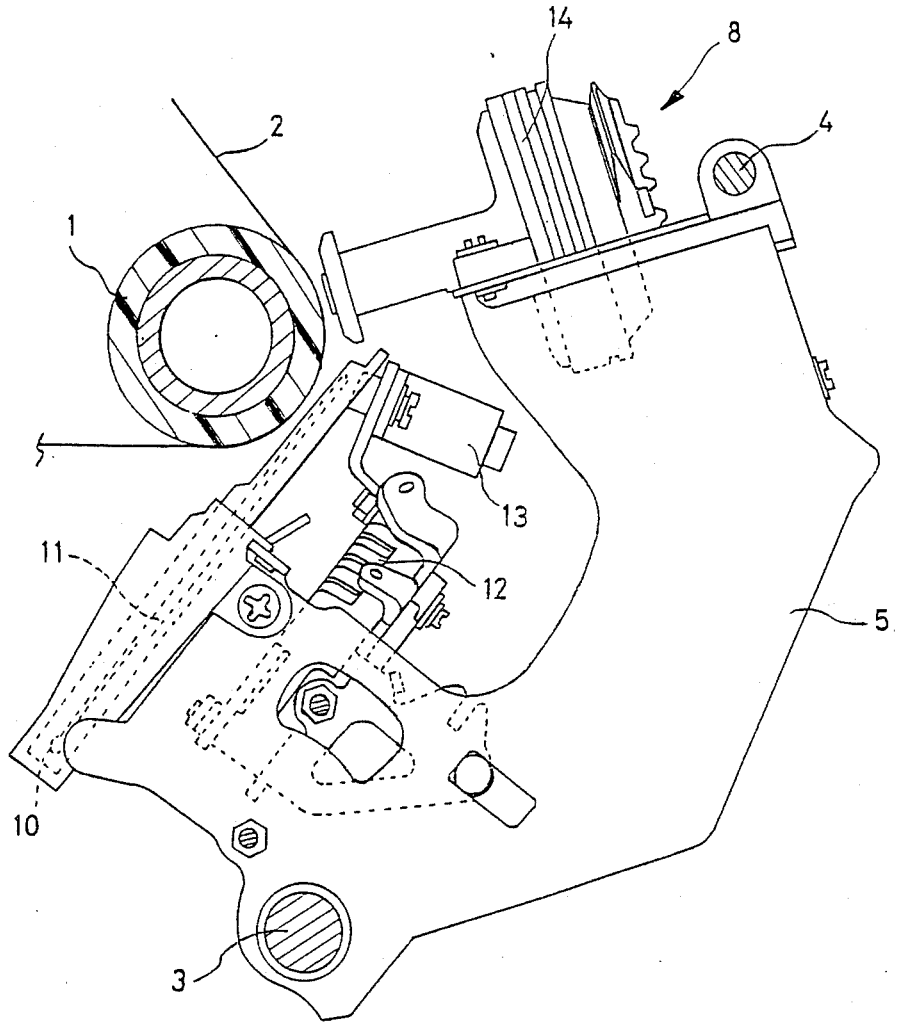
FIG. 6 is a side elevational view showing a modified embodiment of the present invention.

While the first and second printing assemblies 7, 8 of the illustrated embodiment are disposed such that their printing points are located in spaced-apart relation on a line parallel to the line of printing, these two printing assemblies 7, 8 may be disposed so that their printing points are spaced from each other in the direction perpendicular to the line of printing, i.e., in the circumferential direction of the platen 1, as illustrated in FIG. 6. In this modified arrangement, one of the printing operations by the print wheel 11 and the wire-dot print head 14 is effected in one direction along the printing line, and the other printing operation is effected in the same or opposite direction after the sheet of paper 2 is fed by a distance equal to the distance between the the printing points of the first and second printing assemblies 7, 8.

It will be obvious that the invention may be embodied with other changes, modifications and improvements which may occur to those skilled in the art, in the light of the foregoing teaching, without departing from the spirit and scope of the invention defined in the appended claims.

What is claimed is:

1. A composite printing apparatus including a first printing assembly which has character fonts, and a second printing assembly for printing characters with a matrix of dots, comprising:

a carriage which carries said first and second printing assemblies and which reciprocates along a line of printing;

a carriage drive motor for reciprocating said carriage along said line of printing;

separator means comprising a memory for storing a series of input printing data corresponding to a plurality of successive characters which constitute at least one line of characters, said separator means being operable for classifying said series of input printing data into a first group of printing data for a first printing operation with the character fonts of said first printing assembly, and a second group of printing data for a second printing operation with the matrix of dots of said second printing assembly;

printing control means for activating one of said first and second printing assemblies according to a corresponding one of said first and second groups of printing data, and subsequently activating the other printing assembly according to the other one of said first and second groups of printing data, and for thereby effecting a mixed type and dot-matrix printing in the same line of printing which comprises said line of characters;

said printing control means including first carriage control means for activating said carriage drive motor to feed said carriage in one of opposite directions along said line of printing in increments of a one-character distance when said first printing operation is effected according to said first group of printing data, said printing control means further including second carriage control means for activating said carriage drive motor to feed said carriage in the other direction continuously at a predetermined feed rate when said second printing operation is effected according to said second group of printing data.

2. A composite printing apparatus according to claim 1, wherein said printing control means further includes first and second ribbon control means for controlling the operation of a ribbon drive motor for feeding a ribbon through which said first and second printing operations are effected by said first and second printing assemblies, respectively, said first ribbon control means activating said ribbon drive motor to feed said ribbon in increments of a one-character distance when said first printing operation is effected, and activating said ribbon drive motor to feed said ribbon continuously at a predetermined feed rate when said second printing operation is effected.

3. A composite printing apparatus according to claim 1, wherein said separator means further comprises a first print buffer for storing first converted character data corresponding to said first group of printing data, and a second print buffer for storing second converted character data corresponding to said second group of printing data.

4. A composite printing apparatus according to claim 1, wherein said memory of said separator means comprises an input buffer for storing said series of input printing data, a first print buffer for storing type-font data for selecting and impacting the character fonts of said first printing assembly, and a second print buffer for storing dot-matrix pattern data representative of dot-matrix patterns corresponding to the characters to be printed by said second printing assembly.

5. A composite printing apparatus according to claim 3, wherein said separator means causes said first and second print buffers to store space data in addition to said first converted character data and said second converted character data, respectively, said space data to be stored in said first print buffer corresponding to said second converted character data to be stored in said second print buffer, while said space data to be stored in said second print buffer corresponding to said first converted character data to be stored in said first print buffer.

6. A composite printing apparatus according to claim 5, said separator means causes said first and second print buffers to store tab data in addition to said first and second converted character data, respectively, said tab data to be stored in said first print buffer corresponding to said second converted character data to be stored in said second print buffer, while said tab data to be stored in said second print buffer corresponding to said first converted character data to be stored in said first print buffer.

7. A composite printing apparatus according to claim 1, wherein said first and second printing assemblies are disposed such that their printing points are spaced from each other in a direction parallel to a line of printing.

8. A composite printing apparatus according to claim 1, wherein said first and second printing assemblies are disposed such that their printing points are spaced from each other in a direction perpendicular to a line of printing.

9. A composite printing apparatus according to claim 1, further comprising a type-font data memory and a dot-matrix pattern data memory, said type-font data memory storing type-font data which includes type selection data for bringing the character fonts of said first printing assembly into a printing position, and impact data representative of impact forces with which the character fonts are impacted upon said first printing, said dot-matrix pattern data memory which stores dot-matrix pattern data representative of dot-matrix patterns corresponding to the characters to be printed by said second printing assembly.

10. A composite printing apparatus according to claim 1, wherein said printing control means comprises a first and a second printing control unit, said first printing control unit controlling the operation of a font drive motor for bringing the character fonts of said first printing assembly into a printing position and the operation of a hammer for impacting the character fonts in said printing position, according to said first group of printing data, said second printing control unit controlling the operation of a dot-matrix print head according to said second group of printing data.

11. A composite printing apparatus according to claim 1, further comprising a selector switch for selecting a first mode in which said first printing operation is effected, and a second mode in which said second printing operation is effected.

12. A composite printing apparatus according to claim 3, wherein each of said first and second converted character data consists of plural bits of data, said separator means, upon receiving the input character data, reading the corresponding converted character data and comparing a value of at least one of said plural bits with a predetermined reference value, to thereby make a judgement whether the converted character data should be stored in said first print buffer or in said second print buffer.

* * * * *